US008556744B1

(12) United States Patent
Folck et al.

(10) Patent No.: US 8,556,744 B1
(45) Date of Patent: Oct. 15, 2013

(54) METHOD OF APPLYING DECORATIVE LAYERS TO A STEEL SHAFT

(75) Inventors: Scott Edward Folck, Solana Beach, CA (US); Daniel R. Barelmann, Encinitas, CA (US); Eric Michael Sentianin, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 18 days.

(21) Appl. No.: 13/366,959

(22) Filed: Feb. 6, 2012

Related U.S. Application Data

(62) Division of application No. 12/242,683, filed on Sep. 30, 2008, now Pat. No. 8,128,994.

(51) Int. Cl.
*A63B 53/12* (2006.01)

(52) U.S. Cl.
USPC ..... 473/316

(58) Field of Classification Search
USPC ..... 473/316–323
See application file for complete search history.

(56) References Cited

U.S. PATENT DOCUMENTS

| | | | | |
|---|---|---|---|---|
| 4,117,791 | A | 10/1978 | Current et al. | |
| 4,304,620 | A | 12/1981 | Ashby et al. | |
| 5,158,297 | A | 10/1992 | Johnson | |
| 5,190,289 | A * | 3/1993 | Nagai et al. | 473/327 |
| 5,390,921 | A * | 2/1995 | De Ruyter | 473/299 |
| 5,575,473 | A * | 11/1996 | Turner | 473/298 |
| 6,679,787 | B2 * | 1/2004 | Unosawa | 473/319 |
| 6,792,831 | B2 | 9/2004 | Crosser | |
| 6,893,596 | B2 | 5/2005 | Haas et al. | |
| 8,157,669 | B2 * | 4/2012 | Hulock et al. | 473/320 |
| 2003/0083143 | A1 | 5/2003 | Kumamoto | |
| 2003/0199333 | A1 | 10/2003 | Blough | |
| 2004/0128776 | A1 * | 7/2004 | Eicher | 14/22 |
| 2005/0054496 | A1 | 3/2005 | Harms et al. | |
| 2005/0113184 | A1 | 5/2005 | Barelmann et al. | |
| 2006/0135281 | A1 | 6/2006 | Palumbo et al. | |
| 2006/0178227 | A1 | 8/2006 | Barelmann et al. | |
| 2006/0194657 | A1 | 8/2006 | Aaron | |
| 2008/0076593 | A1 | 3/2008 | Costa et al. | |
| 2009/0298608 | A1 | 12/2009 | Yatsuda | |

FOREIGN PATENT DOCUMENTS

| | | |
|---|---|---|
| CN | 1266756 A | 9/2000 |
| DE | 0 433 843 A2 | 6/1991 |
| JP | 05-161727 | 6/1993 |
| JP | 11-206936 | 8/1999 |

OTHER PUBLICATIONS

Promenschenkel, "TaylorMade Burns on with TP Fairway, Draw Driver, and XD Irons," downloaded from http://thesandtrap.com/b/bag_drop/taylormade_burns_on_with_tp_fairway_draw_driver_and_xd_irons, 6pp. (Aug. 27, 2007).

* cited by examiner

*Primary Examiner* — Stephen L. Blau
(74) *Attorney, Agent, or Firm* — Klarquist Sparkman, LLP

(57) ABSTRACT

A method of applying decorative layers to a steel golf club shaft is disclosed. The method may be performed on any type of steel shaft and comprises buffing the steel shaft, applying a primer or sealer coat, curing the sealer coat, buffing the sealer coat, applying a decal or decorative layer, applying clear coat over the shaft and decal, and curing the clear coat layer. Some embodiments comprise applying a layer of base coat color before applying a decal. Disclosed methods can, for example, improve adhesion between chrome-plated steel golf club shafts and paint, for golf club branding with increased resistance to wear.

7 Claims, 5 Drawing Sheets

METHOD OF APPLYING DECORATIVE LAYERS TO A STEEL SHAFT

CROSS REFERENCE TO RELATED APPLICATION

This application is a divisional of U.S. patent application Ser. No. 12/242,683, filed on Sep. 30, 2008 now U.S. Pat. No. 8,128,994, which is incorporated herein by reference.

FIELD

The present disclosure relates to applying decorative layers to metal shafts, including steel golf club shafts.

BACKGROUND

It is sometimes desirable for golf club manufacturers or corporate owners of golf clubs to identify their corporate brand on the golf club shaft. It can also be desirable to apply some other design, identification, information, or coloring on a golf club shaft or other metal shaft for aesthetic or other purposes.

Prior art methods of applying branding to steel shafts typically involve applying a sticker to the shaft, which may not be aesthetically pleasing. Such stickers include silk screen stickers, which are subject to wear and/or peeling away from the shaft. Additionally, stickers may cheapen the look of a high quality golf club shaft, and are less than desirable to manufacturers and corporate owners. Application of a heat transfer decal to a composite golf shaft is described in Barelmann and Folek, U.S. Patent Application Publ. 2006/0178227, that is incorporated herein by reference.

Steel golf club shafts are often manufactured with an outer layer of chrome plating to prevent corrosion of the steel. However, this chrome layer makes it more difficult to apply designs of any kind to the golf club shaft. Prior art methods of applying branding to steel shafts using paint have not met with great success because of poor adhesion between chrome and paint.

Thus, a need remains for an improved method of branding and applying surface indicia to metal shafts, such as steel shafts, that provides good adhesion as evidenced by, for example, industry standard rub and cross-hatch tests.

SUMMARY

To address the need for an improved method of branding steel golf club shafts, the present application discloses, in one embodiment, a method comprising providing a steel shaft, applying primer to the steel shaft, curing the primed steel shaft, applying a decal to the steel shaft, and applying a clear coat layer to the shaft. Some embodiments further comprise buffing the steel shaft after applying the primer and/or additionally buffing the steel shaft before applying the primer. Additionally, some embodiments further comprise applying a base coat layer of paint before applying the decal.

While there is flexibility in the order and number of steps performed, one example of a method of applying one or more decorative layers to a steel golf club shaft comprises providing a steel shaft, buffing the steel shaft in a buffing machine, applying primer to the steel shaft, curing the primed steel shaft, buffing the primed steel shaft, applying a base coat layer, curing the base coat layer, buffing the base coat layer, applying a decal to the steel shaft, applying a clear coat layer to the shaft; and curing the clear coat layer.

The primer used in various disclosed methods may be a specially formulated primer or sealer coating for use with steel golf club shafts.

In some embodiments, the decal may be a heat transfer decal. The decal may be applied using a dual-roller fixture. Disclosed methods may provide for applying the decal substantially all the way around the circumference of the shaft.

Disclosed methods may be performed using various types of steel shafts, including chrome-plated steel shafts, non-plated steel shafts, and nickel-plated steel shafts.

In some examples, methods comprise providing a steel shaft and buffing at least a portion of an exterior surface of the steel shaft to provide a roughened surface area. A primer layer is applied to at least a portion of the roughened surface area and a decal is applied to a portion of the primer layer situated at the roughened surface area. Typically, the entire shaft length is buffed. A clear coat layer is applied to at least a portion of the decal. In some examples, at least a portion of the exterior surface of the steel shaft is defined by a metallic protective layer applied to the steel shaft. In other examples, the metallic protective layer is a chrome layer, a nickel chrome layer, a nickel layer, or a combination thereof. These and other metallic coatings can be applied by plating or using powder coating or physical vapor deposition. In other examples, buffing the steel shaft comprises removing at least some of the metallic protective layer. In further representative embodiments, the decal is a heat transfer decal that is applied by pressing the decal against the primer layer at a temperature of at least 75° C. In still further examples, the primer layer is buffed before the heat transfer decal is applied. In some specific examples, the heat transfer decal wraps substantially around the circumference of the steel shaft. In additional representative embodiments, the heat transfer decal is applied by pressing the heat transfer decal against the primer layer with a heated steel plate which bears the decal to at least two metal rollers. In other embodiments, a colored base coat layer is applied to at least a portion of the primer layer before applying the heat transfer decal. Typically, a clear coat layer is applied to the heat transfer decal after the decal is secured to the primer layer. In some convenient examples, the colored based coat extends along the length of the steel shaft from about a grip end to a club head end, and the heat transfer decal is applied so as to be adjacent the grip portion of the steel shaft.

Other methods comprise providing a steel shaft and buffing at least a portion of the steel shaft to provide a roughened surface area. A primer layer is applied to at least a portion of the roughened surface area and at least a portion of the primer layer is buffed. A colored base coat layer is applied to at least a portion of the buffed primer layer, and a clear coat layer is applied to the colored base coat layer. In representative examples, the colored base coat and the roughened surface area extend from a grip portion of a shaft to a club head end and extend substantially completely around a shaft circumference. In other examples, at least a portion of the colored base coat layer is buffed and a decal is applied to the buffed base coat layer so that the clear coat layer is applied to the decal and the colored base coat layer. In further embodiments, the decal is a heat transfer decal and the shaft is a golf club shaft.

Golf club components comprise a steel shaft having a metallic protective coating situated on at least a portion of an exterior of the steel shaft. The metallic protective coating comprises chrome, nickel, or nickel-chrome or a combination thereof, and the metallic protective coating includes a buffed portion. In further examples, the metallic protective coating substantially covers an exterior of the steel shaft. In additional embodiments, the steel shaft has a club head end portion configured for attachment to a golf club head and a grip end portion configured to receive a golf club grip, and the buffed portion is situated between the club head end portion and the grip end portion. In other examples, the buffed portion extends completely around the shaft. In still further representative examples, a primer coat is situated on at least a portion of the buffed portion of the metallic protective layer, at least one of a decal or a colored base coat layer is situated on the primer coat, and a clear coat layer covers the decal and/or the base coat layer.

Golf clubs comprise a plated shaft having a buffed portion to which a decal is applied, the buffed portion situated in proximity to a grip end of the plated shaft, and a clear coat covering the decal. A golf club head is secured to a head end of the plated shaft and a grip is secured to the grip end of the plated shaft. In some examples, the buffed portion of the plated shaft extends substantially from the grip end to the head end, and the plated shaft further comprises a colored base coating extending from the decal to the head end. Typically the plated shaft includes a chrome, nickel, or nickel-chrome exterior plating layer that is thinned and roughened in at least the buffed portion. In some examples, the entire exterior surface of the plated shaft is buffed.

The foregoing and other objects, features, and advantages of the invention will become more apparent from the following detailed description, which proceeds with reference to the accompanying figures.

DETAILED DESCRIPTION

As used in this application and in the claims, the singular forms "a," "an," and "the" include the plural forms unless the context clearly dictates otherwise. Additionally, the term "includes" means "comprises." Further, the term "coupled" means physically or mechanically coupled or linked and does not exclude the presence of intermediate elements between the coupled items.

Although the operations of embodiments of the disclosed method are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed system, method, and apparatus can be used in conjunction with other systems, methods, and apparatus. Additionally, the description sometimes uses terms like "produce" and "provide" to describe the disclosed method. These terms may be high-level abstractions of the actual operations that can be performed. The actual operations that correspond to these terms can vary depending on the particular implementation and are discernible by a person of ordinary skill in the art.

The present disclosure concerns methods of applying one or more decorative layers to steel and other metal shafts, such as steel golf club shafts. Such methods can be useful as, for example, aesthetic ways to brand or decorate steel golf club shafts.

Figure 7:
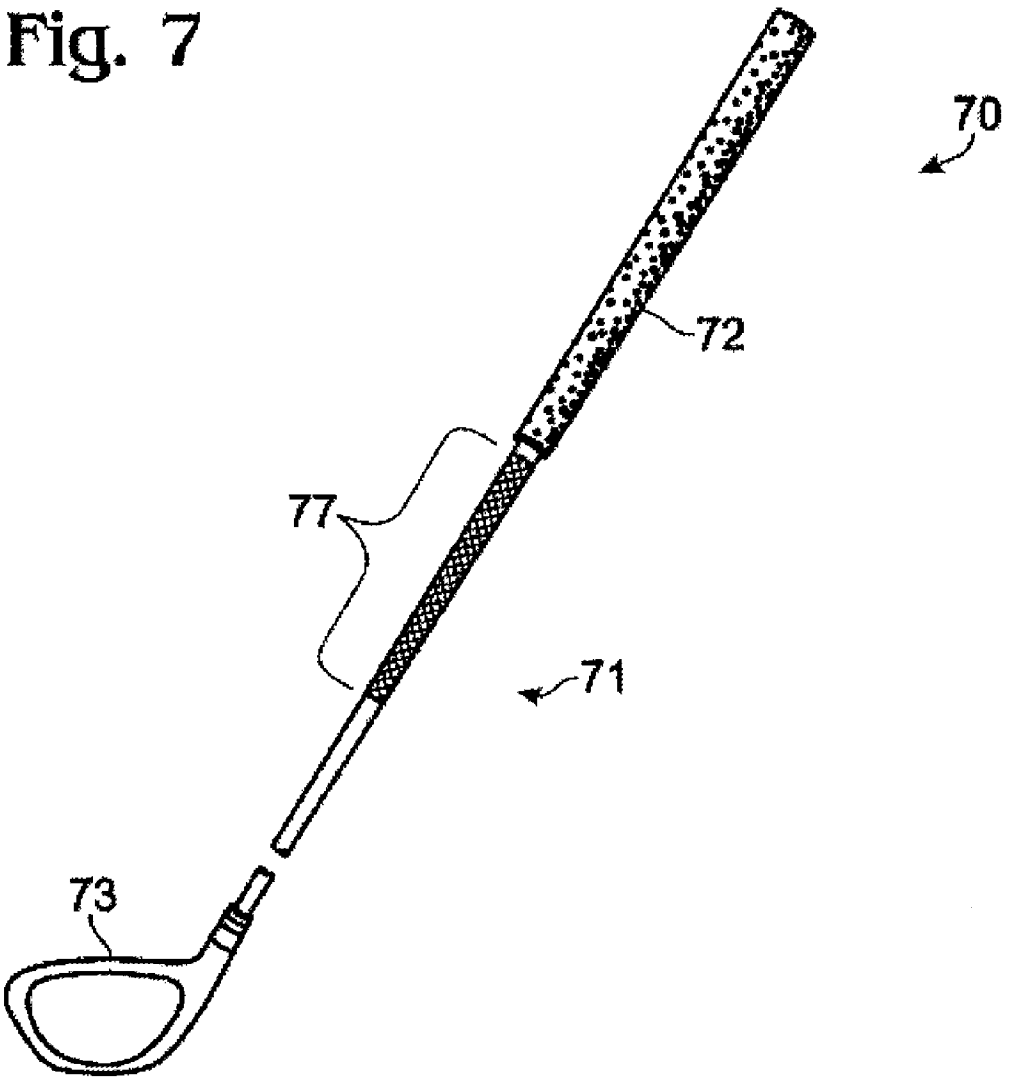
FIG. 7 illustrates a representative golf club that includes a metallic shaft having a decorative layer.

Referring to FIG. 7, a representative golf club 70 includes a shaft 71, a grip 72, and a golf club head 73. The golf club head 73 is illustrated as a metal wood type head but can be an iron or hybrid type golf club head, or a putter head. The grip 72 is generally situated over a portion of the shaft that is between about 10 cm and 40 cm long or longer. The shaft 71 is generally tapered so that the shaft diameter decreases from the grip end to the club head 73. Although not shown in FIG. 7, the shaft 71 typically has a stepped taper defined by a series of steps that are between 1 cm and 5 cm long. A decorated region 77 is also provided that typically extends to the grip 72 and can extend partially along the shaft toward the club head 73 or along the entire length of the shaft. In some examples, decorative coatings are applied in some portion of the decorated region along with one or more decals. In some examples, the decorative coatings or decals can include indications of shaft or club type or other indicia. In other examples, colored base coats can be provided instead of or in addition to one or more decals. Typical shafts include an exterior protective metallic layer, typically a plated layer of chrome, nickel, copper, or a combination thereof. Adherence of decals or colored base coats to such plated shafts can be promoted by buffing portions of the plated layer as described in detail below.

Figure 1:
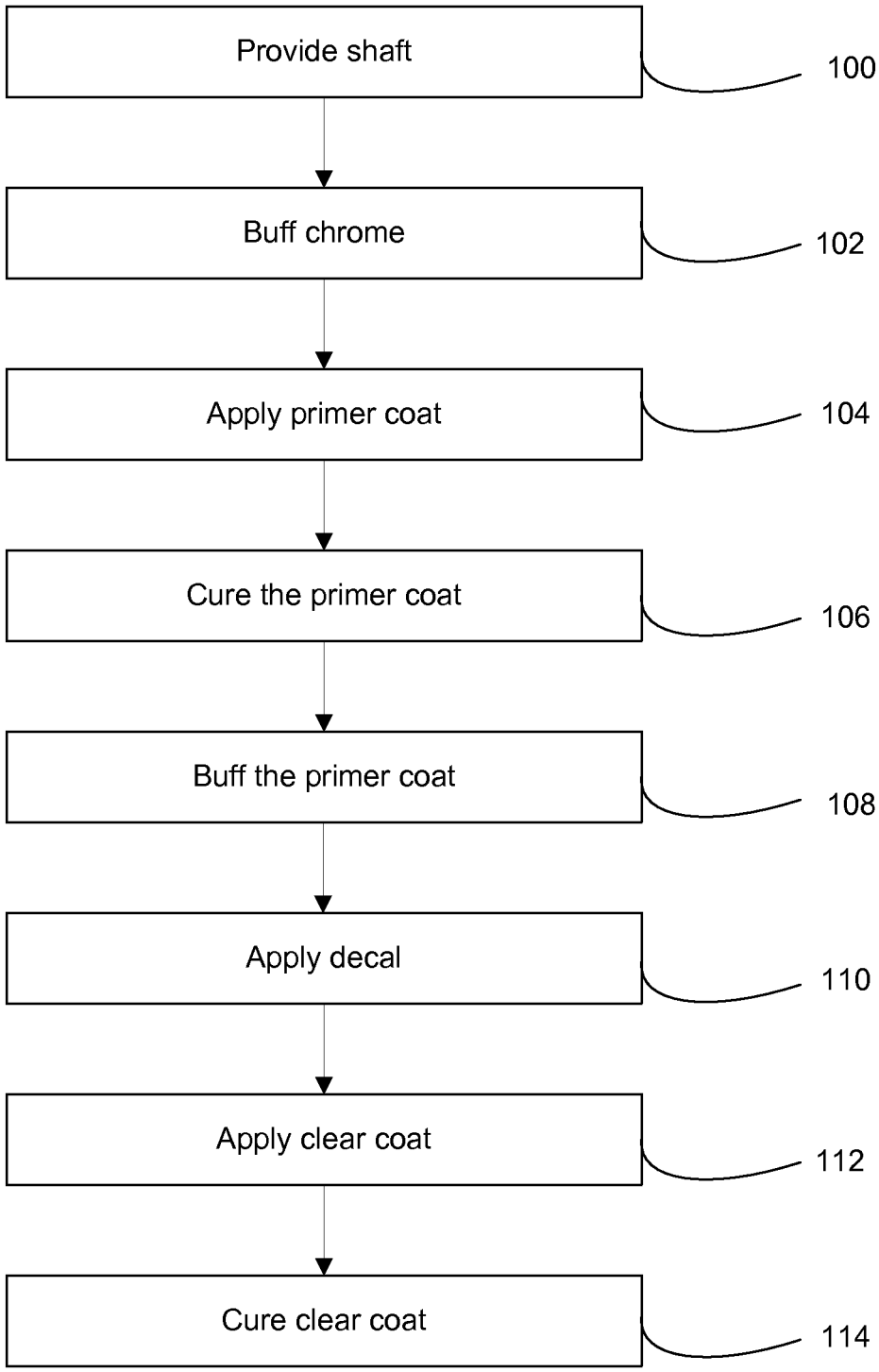
FIG. 1 illustrates a block diagram of one embodiment of a method of applying one or more decorative layers to a steel shaft.

In one embodiment, shown in FIG. 1, a steel shaft, such as a steel golf club shaft, is provided (step 100). Suitable steel shafts may be non-plated, nickel-plated, nickel-chrome plated, chrome-plated or otherwise provided with a protective, corrosion resistant, or other exterior layer, typically a metallic exterior layer. Additionally, precision stepless steel shafts, as well as traditional stepped steel shafts may be used. The method can be performed substantially as described regardless of whether a stepless or stepped shaft or other tapered or untapered shafts are used.

The steel shaft can be buffed (step 102), such as by placing the shaft in a buffing machine with a flapper wheel. Typically the steel shaft has a plated chrome exterior that can be buffed for various amounts of time, using various amounts of pressure, and using various types or grits of buffing wheels, belts, pads, abrasive slurries, or other buffing, polishing, or abrading mixtures or surfaces. In other examples, a shaft can be provided with a suitable surface by sand blasting or bead blasting, or other roughening surface treatment. The specifications for buffing will vary depending on the type of metal shaft, the thickness or any plating layers on the exterior surface of the metal shaft, as well as the desired results of the buffing. Additionally, different sizes of buffing wheels, belts, etc. may be used to buff the shaft, depending on the size of the shaft (e.g. length and diameter) and the type of machine or tooling used to perform the buffing. In one embodiment, a chrome-plated steel golf club shaft can be buffed using a buffing wheel, such as 8 inch diameter, 2 inch wide hard aluminum oxide buffing wheel with medium grit (available from Standard Abrasives, Inc., Simi Valley, Calif.). In one embodiment, the buffing wheel rotates at a speed of about 8 rpm and is applied to the shaft with a force of about 1.2 Kgf for about 4 seconds. Buffing can be performed at slower or faster buffing wheel speeds, with higher or lower forces, and/or for more or less time depending on the particular application and desired results. All of these parameters can be varied in order to achieve the desired surface properties of the shaft and final thickness of the chrome or other protective layer.

Additionally, different buffing wheels or belts can be used to buff the steel shaft. For example, different buffing wheels may result in different cosmetic appearances or brushed steel patterns; thus the choice of buffing wheel can be influenced by the desired outcomes or aesthetic appearance. Generally any buffing wheel, belt, or other device can be used to buff the shaft so long as it creates an adequately rough surface for later processing steps (e.g., primer or sealer coat adherence). In some examples, substantially the entire length of the shaft is buffed or otherwise treated, or at least the potions of the shaft exterior that remains visible after attachment of a golf club head and a club grip to the shaft. Typically a buffed or otherwise treated portion of a shaft exterior surface has a finely ground, brushed, or similar appearance. In some examples, a buffed surface portion is nearly specularly reflective, and appears slightly hazy or diffusing in comparison with a polished or other highly reflective surface of a similar material. Such a buffed surface can have a slightly darker appearance than a polished surface, but absent close inspection, may appear substantially similar to a polished, unbuffed surface. Thus, substantial portions of a shaft can be buffed but retain a polished appearance after processing is complete. In some examples, coating layers such as clear coats, primer coats, or sealer coats applied to undecorated but buffed areas tend to restore a shiny, polished appearance.

In alternative embodiments, sanding equipment such as typically used on graphite shafts can be used to roughen or buff the surface of the steel shaft. In some embodiments, the wheel or belt speed and pressure applied are less for buffing the steel shafts than is typical for buffing graphite shafts. In some embodiments, the steel shaft can be buffed two or more times, with belts, wheels, slurries, or polishing, buffing, or grinding compounds of successively finer grit size. In other embodiments, graphite or shafts or surfaces of other materials can be similarly processed and decorated.

In some embodiments, only a small portion of chrome layer thickness is removed during the buffing step 102. In other embodiments, a substantial amount of the chrome plating is removed, such as about 75%. In some embodiments, from about 24% to about 50% of the thickness of the chrome layer is removed in buffing step 102. In still other embodiments, all or substantially all of the chrome layer is removed in buffing step 102. In one embodiment, about 0.5 grams of a chrome layer can be removed from the shaft, which in some cases corresponds to removal about 0.15 mm of layer thickness over a shaft length of greater than about 35 inches. The total mass of a chrome or other surface layer removed generally depends on the length of the buffed area, and whether the buffed area extends around the entire circumference of the shaft. Typically, a mass per unit length of between about 0.005 g/cm and about 0.5 g/cm is removed from golf club shafts having diameters between about 5 mm and 20 mm, though typical shafts have diameters of between 8 mm and about 16 mm. In some embodiments, just enough of the chrome player can be removed in order to provide a surface rough enough for further processing steps (e.g., for a primer coat to adhere well) yet enough of the chrome layer thickness can remain on the shaft in order to provide protection from environmental elements. In some embodiments, the remaining chrome layer after buffing is selected to prevent or retard corrosion of an underlying steel shaft, provide shaft durability, and/or provide desired cosmetic effects. In some embodiments, the surface of the chrome layer appears roughened or abraded after the buffing step 102. In some embodiments, enough chrome remains on the shaft after the buffing step 102 such that no underlying layers (e.g. nickel or steel) are exposed, thus preventing or retarding shaft corrosion. Sealer coats described below also provide corrosion resistance and promote shaft durability. Thus, the amount of chrome layer remaining (if any) can vary depending on the desired application of the shaft, for example, the desired cosmetic appearance or the predicted amount of durability required.

The shaft can be coated with a sealer coat, or primer (step 104). The primer can comprise a standard base resin and additives formulated for adhesion to steel or other metal surfaces such as chrome, nickel, or nickel-chrome surfaces or non-metallic surfaces. The primer can be applied to substantially the entire length of the shaft including both buffed and unbuffed portions. Alternatively, the primer can be applied only to a portion of the shaft length such as, for example, a buffed area or a selected portion of a buffed area. Similarly, the primer can be applied either around the entire circumference of the shaft, or around only a portion of the circumference. The primer can be applied using any suitable method, such as by spray coating. The primer can also be coated onto the shaft that is put inside a drum. The shaft can then be pulled through an opening in a taut piece of material connected to the top of the drum. This can result in a thin, even layer of primer applied to the shaft. Other suitable methods of applying a sealer or primer coat can be used. In some embodiments, a total amount of primer or sealer coating applied can range from about 0.5 g to about 0.7 g to a buffed shaft length of between about 70 cm and 120 cm. Typically, primer or sealer coatings are not provided to the grip portion of a shaft. In other examples, a grip portion of the shaft situated at a largest diameter end of a tapered shaft of length between about 10 cm and 40 cm is uncoated and/or unbuffed. In other examples, even the grip portion is coated and buffed for convenience, although this portion is eventually covered by a club grip. More or less primer or sealer coat can be applied, depending on the size of the shaft, as well as various other parameters (e.g., method of primer/sealer application or desired properties of a sealer/primer layer). In some embodiments, the resulting layer of the primer or sealer coat is about 0.010 inches thick, however, a thicker or thinner layer of primer or sealer coat can also be used. For example, in some embodiments, the thickness of the primer or sealer coat can range from about 0.001 inches to about 0.010 inches or thicker.

The primer may comprise urethane for its ability to adhere to steel, chrome, nickel or other protective layer as well as its sealing properties and corrosion resistance. Some suitable primers can exhibit isotropic properties. One example of a suitable primer is PPG Sports Coating or Pro-coat (available from PPG Industries, Pittsburgh, Pa.). Suitable primer or sealer coats can comprise approximately 80% base resin, as well as one or more additives and one or more catalysts.

After the primer is applied to the shaft, the primer layer is cured (step 106). Curing may be performed by placing the coated shaft into an oven and heating the coated shaft at a sufficient temperature to cure the primer coating, such as at a temperature of about 90° C., for a sufficient amount of time to cure the primer coating, such as about 45 minutes. Curing time and oven temperature can vary depending on the specific formulation of primer or sealer coat. For example, curing can be accomplished in an oven heated to around 90° C. for around 20 minutes or more. A standard oven can be used for curing the primer or sealer coat. In some embodiments, the oven can be provided with a ramp cycle for varying and cycling the temperature applied to the shaft.

Once cured, the primer or sealer coat can be buffed lightly (step 108), such as with a Scotch-Brite™ belt (3M, St. Paul, Minn.), or approximately 1000 grit sand paper or similar. Depending on the particular machine or tooling used to buff the primer or sealer coat, coarser or finer grits can be used. In some embodiments, the same buffing machine used to buff the shaft exterior including chrome or other shaft exterior layer can be used to buff the primer or sealer coat, but with a belt instead of a buffing wheel. In some embodiments, a single grinding machine can be used. In some embodiments, a buffing machine with, for example, a flapper wheel can be used to buff the primed shaft. If a buffing machine is used, a relatively low force and wheel speed can be used, such as a force of about 1.0 Kgf or less and a wheel speed of about 7 rpm or less. In some embodiments, the primer or sealer coat can be buffed at a force of from about 1 Kgf to about 1.5 Kgf. In some embodiments, a faster wheel or belt speed can be used, such as from about 50 rpm to about 80 rpm. In some embodiments, the wheel speed and pressure can be varied (e.g., increased or decreased) so as to roughen or buff the primer or sealer layer so as to promote adhesion of additional layers or decals. Typically, complete removal of the primer or sealer coat layer is avoided. After buffing, the shaft can be wiped or cleaned with acetone, alcohol, or other solvents or cleaning agents.

Figure 3A:
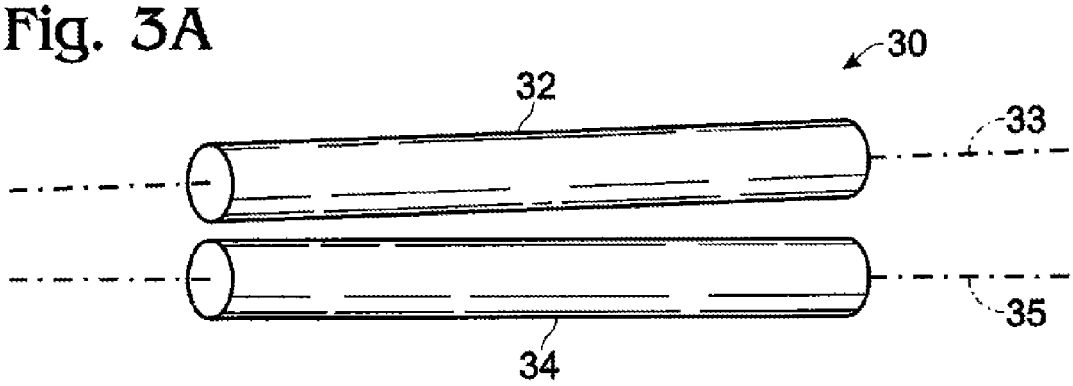
FIGS. 3A-3B illustrate a dual roller fixture that can be used to apply one or more decorative layers to a steel shaft.
Figure 3B:
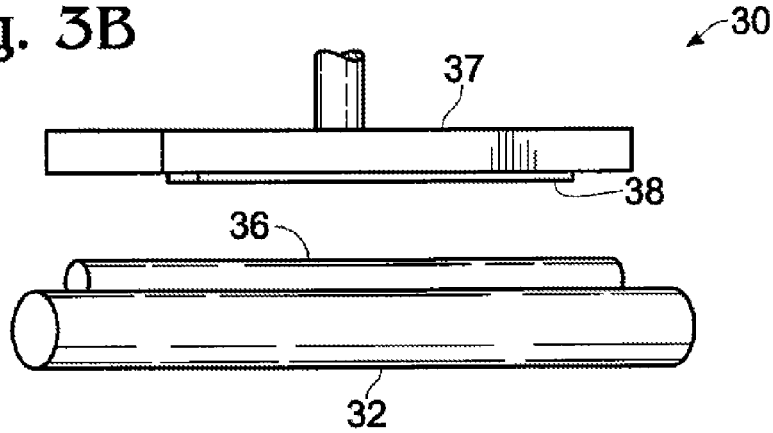

One or more decals or other decorative layers can be applied to the buffed sealer coated golf club shaft (step 110). In some embodiments, a heat transfer machine can be used to apply a decal or branding decoration using, for example, a dual-roller fixture 30, as seen in FIGS. 3A-3B. The dual-roller fixture 30 can comprise metallic rollers 32, 34 that are situated along respective axes 33, 34 that are tilted about 1-4 degrees with respect to each other to accommodate tapered shafts. As shown in FIG. 3B, a metal (usually steel) die plate 37 is situated to receive a heat transfer decal 38 and is movable so as to bring the heat transfer decal 38 into contact with a shaft 36. The rollers 32, 34 are configured to permit the shaft to rotate so that the heat transfer decal is pressed against the shaft 36 so as to conform to the shaft 36, reducing bubbles. Metallic rollers and a heat transfer plate permit heat transfer at temperatures of at least 50-200° C. or hotter. Typically the rollers are 20-40 cm long to reduce roller marks in application of long decals. However, decal application can be performed using any suitable method or application technique, and multiple short rollers can be used.

In other embodiments, a dual-roller fixture is not used. In some embodiments, paint may be applied directly to the primer coated shaft, in addition to or instead of a decal. In other embodiments, a decal can be applied using any appropriate method of application that applies heat and pressure to the decal, such as application using an iron.

Unlike stickers, decals are typically provided without an adhesive backing. Some decals comprise ink on a Mylar® backing, which releases from the decal once heat and/or pressure are applied. The decal may wrap completely around the shaft circumference in some embodiments, and only partially around the shaft circumference in other embodiments. Additionally, if a stepped shaft is provided, the decal may be applied over the steps, or alternatively, each decal may only be applied to a single step. Furthermore, multiple decals can be provided. In some embodiments, the decal can be applied as a 360 degree full wrap branded decal containing multiple colors.

Returning to the method shown in FIG. 1, after one or more decals and/or decorative layers have been applied to the golf club shaft, a clear coat layer can be applied over the shaft and decorative layers (step 112). The clear coat can be applied substantially over the entire shaft. In alternative embodiments, the clear coat can be applied over only a portion of the shaft, such as just over the portion of the shaft having a decal applied. The clear coat can be applied using any suitable technique, such as by spray coating, dip coating, or any method described above in connection with application of the primer or sealer coat. Any suitable thickness of clear coat can be applied. In one embodiment, the clear coat can be applied to a thickness of about 0.03 mm to about 0.05 mm, and total mass of the clear coat layer is between about 0.8 g and 1.0 g. The clear coat can contain additives to increase adhesion with the decal and/or the underlying primer layer or paint layer. Any suitable clear coat layer can be applied. In some embodiments, the clear coat layer is hard enough after curing to pass durability testing requirements of particular applications. In some embodiments, the clear coat layer remains soft enough after curing to resist marring and scratches.

Finally, the clear coat can then be cured (step 114) by placing the coated shaft in an oven heated to a sufficient temperature and for a sufficient amount of time to cure the clear coat, without damaging the shaft and any previously applied layers and coatings. One example of an appropriate curing time is about sixty (60) minutes or more, in an oven raised to a temperature of about 90° C. or more. Higher or lower temperatures may be used to heat the golf club shaft for longer or shorter time periods, depending on the specific layers used and curing requirements.

Figure 2:
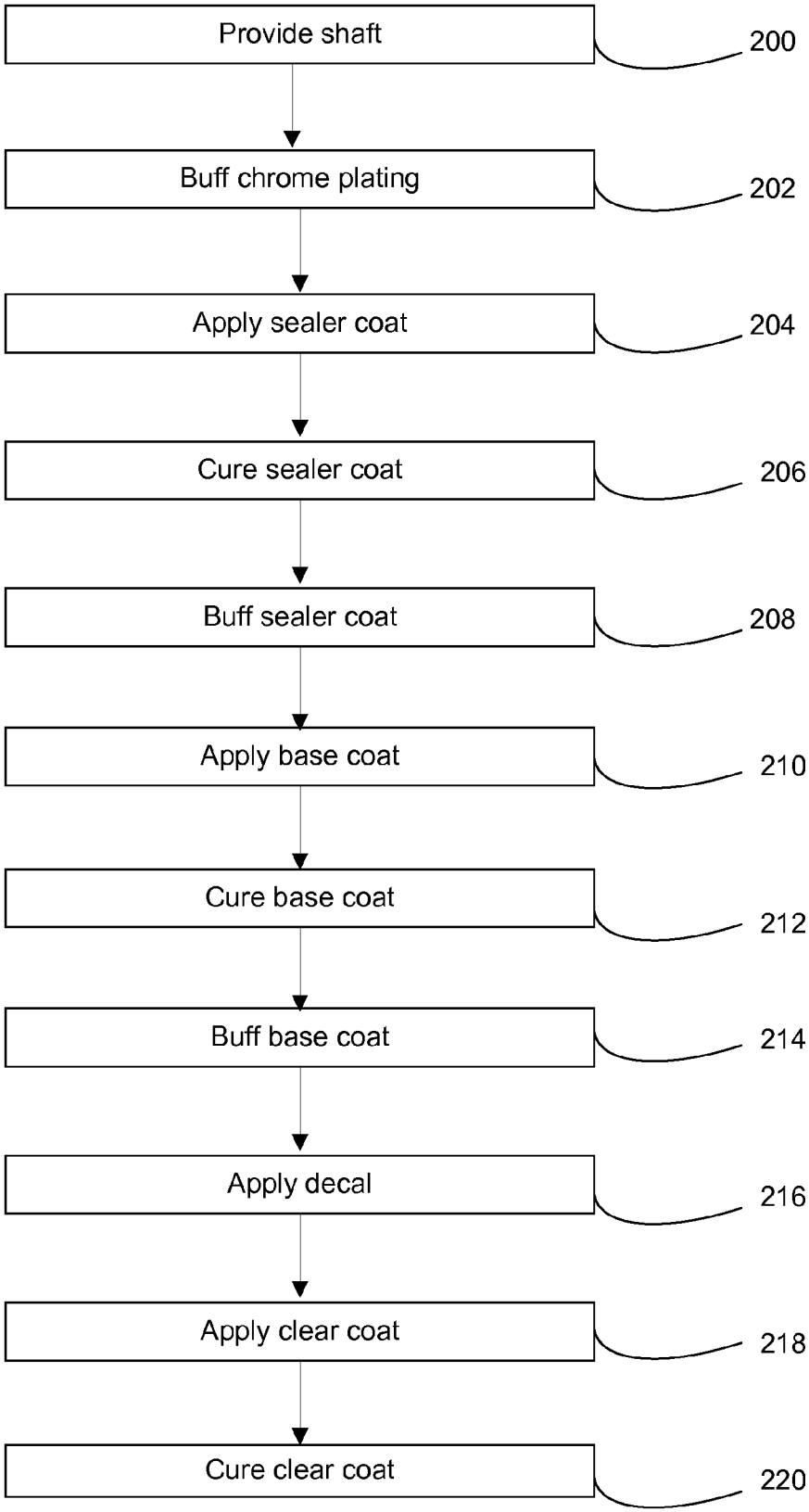
FIG. 2 illustrates a block diagram of an alternative embodiment of a method of applying one or more decorative layers to a steel shaft.

FIG. 2 is a block diagram of an alternative method of applying one or more decorative layers to a steel golf club shaft. Variations and alternatives discussed in connection with the method of FIG. 1 similarly apply to the method illustrated in FIG. 2. First, a steel shaft, such as a chrome plated steel golf club shaft, is provided (step 200). The steel shaft can be buffed (step 202), such as by placing the shaft in a buffing machine with a flapper wheel, to remove some or all of any chrome or other plating or other coating present on the shaft. Next, the shaft can be coated with a sealer coat, or primer (step 204) and cured (step 206). The cured, primed shaft can be buffed lightly (step 208), which may improve adhesion with subsequent coats or layers.

Next a layer of base coat may be applied (step 210). In some embodiments, a layer of black base coat or paint is applied along the entire length and around the entire circumference of the shaft. In alternative embodiments, only a portion of the shaft length and/or circumference may be painted. Any color base paint may be used. Additionally, one or more base coat colors may be used in combination with one another on different areas of the shaft. As with the primer layer and the clear coat layer discussed above, the base coat layer can be applied using any suitable method, such as by spray coating or dip coating.

The base coat layer can then be cured (step 212). Curing can be accomplished using any suitable technique, such as by heating the shaft in an oven heated to a sufficient temperature for a sufficient amount of time to allow the base coat layer(s) to cure. In some embodiments curing times of about 60 minutes in an oven heated to around 90° C. are suitable Longer or shorter curing times and higher or lower temperatures may be sufficient depending on the number of base coat layers, the thickness(es) of the base coat layer(s), and the composition of the base coat itself.

Next, the cured base coat layer can be buffed (step 214), and then one or more decals or other decorative layers can be applied to the buffed, base-coated golf club shaft (step 216). After one or more decals and/or decorative layers have been applied to the golf club shaft, a clear coat layer can be applied over the shaft and decorative layers (step 218) and then be cured again (step 220) for a sufficient amount of time and in an oven heated to a sufficient temperature to cure the clear coat, without damaging the shaft and the applied layers and coatings.

Alternative embodiments of methods of applying one or more decorative layers to a steel golf club shaft may comprise applying multiple layers of sealer or primer to the shaft at different stages of the process. Some embodiments comprise applying one or more layers of base coat at a time. For example, one embodiment may comprise applying a black base coat layer that is cured and buffed, and then another base coat layer of a same or different color, which is cured and buffed before a decal is applied. In some embodiments, the golf club shaft and each layer applied need not be buffed. In some embodiments, each layer applied need not be cured individually. In some embodiments, no decal need be provided. For example, the branding or design could be created entirely using base coat layers. Additionally, in some embodiments, a clear coat layer may be applied, cured, and/or buffed before the decal is applied. In this embodiment, a second layer of clear coat may be applied, cured, and/or buffed after any decal is applied.

Disclosed method steps can be performed at different times and in different locations from one another. For example, in one embodiment, an unplated or chrome plated steel shaft is buffed, primed, and/or cured and then transferred to a separate facility or a customer for buffing of the sealer coat and application of a decal and/or decorative layers.

Some embodiments comprise applying multiple coating layers in addition to the chrome plating to prevent corrosion.

Disclosed embodiments of a method of applying decorative layers to a steel golf club shaft may produce a branded golf club shaft capable of withstanding wear and corrosion. For example, branded golf club shafts according to the present disclose may pass 200 rubs on a rub test apparatus and may pass standard paint cross-hatch tests or other tests such as provided by ASTM D3359 or ISO 2409.

While steel shafts without chrome or other protective coatings can be used, coated shafts are typically preferred for durability and to provide a polished or otherwise attractive shaft surface. Protective coatings such as chrome, nickel, nickel-chrome, or others can be applied in thicknesses ranging from about 0.5 μm to about 1.0 mm or more or less, but typical thicknesses range from about 5 μm to about 300 μm. Buffing of the protective coating layer typically thins the protective coating to about 1%, 10%, 20%, 50%, 75%, or 90% of its pre-buffed thickness. Typically a buffed area is a cylindrical area (or tapered cylindrical area) on a shaft exterior so that the buffed area extends completely around the shaft exterior along a portion or all of a shaft length. In other examples, the buffed area extends only partially around the shaft exterior. Typically, primer or sealer layers are applied so as to substantially cover previously coated, buffed, or roughened portions of a shaft, but in some examples, such layers only partially cover underlying layers or surface treatments.

Figure 4:
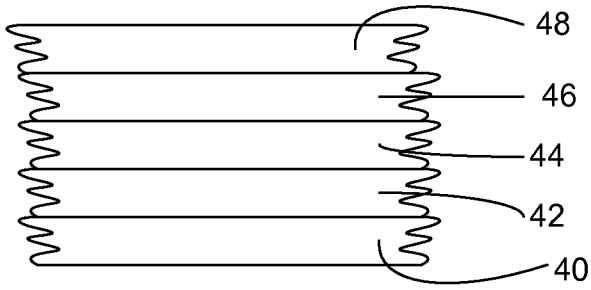
FIG. 4 illustrates a partial cross section of one embodiment of a golf club shaft produced according to presently disclosed methods.
Figure 5:
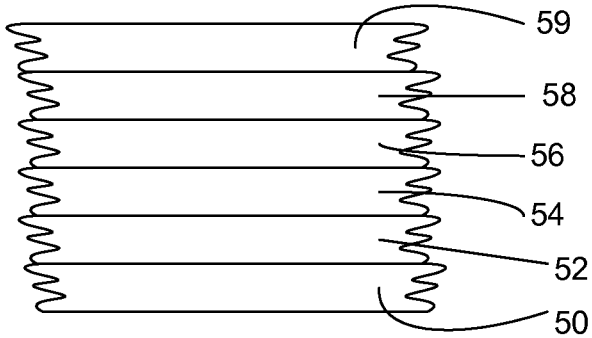
FIG. 5 illustrates a partial cross section of an alternative embodiment of a golf club shaft produced according to presently disclosed methods.
Figure 6:
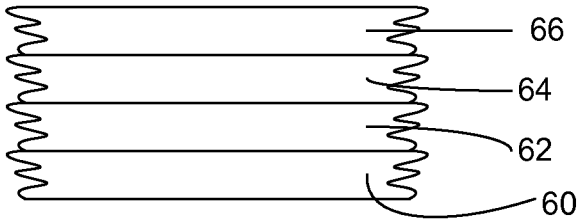
FIG. 6 illustrates a partial cross section of another alternative embodiment of a golf club shaft produced according to presently disclosed methods.

FIGS. 4-6, which are not drawn to scale, illustrate partial cross sections of various embodiments of golf club shafts produced according to disclosed methods. For convenient illustration, curvatures and thickness variations associated with typical tapered or untapered substantially cylindrical golf shafts are not shown in FIGS. 4-6. FIG. 4 illustrates a partial cross section of one embodiment of a golf club shaft produced according to disclosed methods of applying decorative layers. The core of the shaft comprises steel layer 40, on which plating layer 42 may be applied. Plating layer 42 may comprise, for example, a chrome plating layer. A sealer or primer layer 44 is applied on plating layer 42. The sealer or primer layer 44 may comprise the primer composition discussed above. A decal or decorative layer 46 may be applied to the sealer or primer layer 44. Finally, a clear coat layer 48 may be applied to the decal or decorative layer 46.

FIG. 5 illustrates a partial cross section of an alternative embodiment of a golf club shaft produced according to presently disclosed methods. The core of the shaft comprises steel layer 50, on which plating layer 52 may be applied. Plating layer 52 may comprise, for example, a chrome plating layer. A sealer or primer layer 54 is applied on plating layer 52. The sealer or primer layer 54 may comprise the primer composition discussed above. Base coat layer 56 may be applied on the primer layer 54. A decal or decorative layer 58 may be applied to the base coat layer 56. Finally, a clear coat layer 60 may be applied to the decal or decorative layer 58.

FIG. 6 illustrates a partial cross section of another alternative embodiment of a golf club shaft produced according to presently disclosed methods. The core of the shaft comprises steel layer 60, on which a primer or sealer layer 62 may be directly applied. A decal or decorative layer 64 may be applied to the sealer or primer layer 62. Finally, a clear coat layer 66 may be applied to the decal or decorative layer 64.

Each of the golf club shafts illustrated in FIGS. 4-6 may comprise one or more base coat layers. Additionally, each of the illustrated embodiments may or may not comprise a plating layer. Similarly, each of the illustrated embodiments may comprise one or more base coat layers, and/or one or more decal or decorative layers. While the above examples are directed to golf club shafts, similar methods can be applied to the production and ornamentation of other types of shafts or other surfaces, such as those of metal wood type golf club heads.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club component, comprising:

a steel shaft;

a metallic protective coating situated on at least a portion of an exterior of the steel shaft;

wherein the metallic protective coating comprises nickel-chrome; and wherein the metallic protective coating includes a roughened portion a primer coat situated on at least a portion of the roughened portion of the metallic protective layer;

a decal situated on the primer coat; and a clear coat layer covering the decal.

2. The golf club component of claim 1, wherein the metallic protective coating substantially covers an exterior of the steel shaft.

3. The golf club component of claim 1, wherein the steel shaft has a club head end portion configured for attachment to a golf club head and a grip end portion configured to receive a golf club grip, and the roughened portion is situated between the club head end portion and the grip end portion.

4. The golf club component of claim 3, wherein the roughened portion extends completely around the shaft.

5. The golf club component of claim 1, wherein the primer coat includes a roughened portion to which the decal is secured.

6. The golf club component of claim 5, wherein the decal and a colored based coat layer are secured to the roughened portion of the primer coat.

7. The golf club of claim 1, wherein the decal is secured to the steel shaft with sufficient adhesion to pass 200 rubs on a rub test apparatus.

* * * * *